United States Patent [19]

Janowitz

[11] Patent Number: 4,832,230

[45] Date of Patent: May 23, 1989

[54] THREADED CAP CONTAINING ADDITIVE FOR CONTAINERS

[76] Inventor: C. Michael Janowitz, 230 Fifth Ave., New York, N.Y. 10001

[21] Appl. No.: 133,495

[22] Filed: Dec. 15, 1987

[51] Int. Cl.[4] ..... B67D 5/40

[52] U.S. Cl. ..... 222/80; 222/136

[58] Field of Search ..... 222/80, 135–136, 222/145, 383, 478, 481–482, 489, 541; 206/222; 215/6, DIG. 8; 220/23; 141/326, 364

[56] References Cited

U.S. PATENT DOCUMENTS

| | | | |
|---|---|---|---|
| 1,458,975 | 6/1923 | Clauson | 239/317 |
| 2,275,567 | 3/1942 | Smith | 220/23 X |
| 3,083,916 | 4/1963 | Neel | 239/315 |
| 3,318,484 | 5/1967 | Modderno | 222/136 |
| 3,355,238 | 11/1967 | Schwartzman | 222/80 |
| 3,797,708 | 3/1974 | Sypal | 222/193 |
| 4,132,308 | 1/1979 | Goncalves | 206/219 |
| 4,249,562 | 2/1981 | King, Sr. | 137/268 |
| 4,333,493 | 6/1982 | Beiswenger et al. | 137/268 |
| 4,705,191 | 11/1987 | Itzel et al. | 222/80 |

FOREIGN PATENT DOCUMENTS

| | | | |
|---|---|---|---|
| 235115 | 5/1910 | Fed. Rep. of Germany | 239/310 |
| 1083275 | 1/1955 | France | 222/80 |
| 2306898 | 11/1976 | France | 222/80 |
| 11481 | of 1901 | United Kingdom | 239/310 |
| 464244 | 1/1936 | United Kingdom | 299/84 |

*Primary Examiner*—Michael S. Huppert
*Attorney, Agent, or Firm*—Charles E. Temko

[57] ABSTRACT

A threaded cap having an axially-disposed element containing an additive adapted to be engaged upon a threaded neck of a container. As the cap is tightened, the element is distorted resulting in release of the additive which is in liquid form into the container without spilling. In one embodiment, the distortion is the result of engagement of the element with corresponding structure positioned on an inner surface of the neck of the container. In another embodiment, the element is ruptured by an axially aligned plunger which is manually operable by the user.

1 Claim, 2 Drawing Sheets

FIG. 1
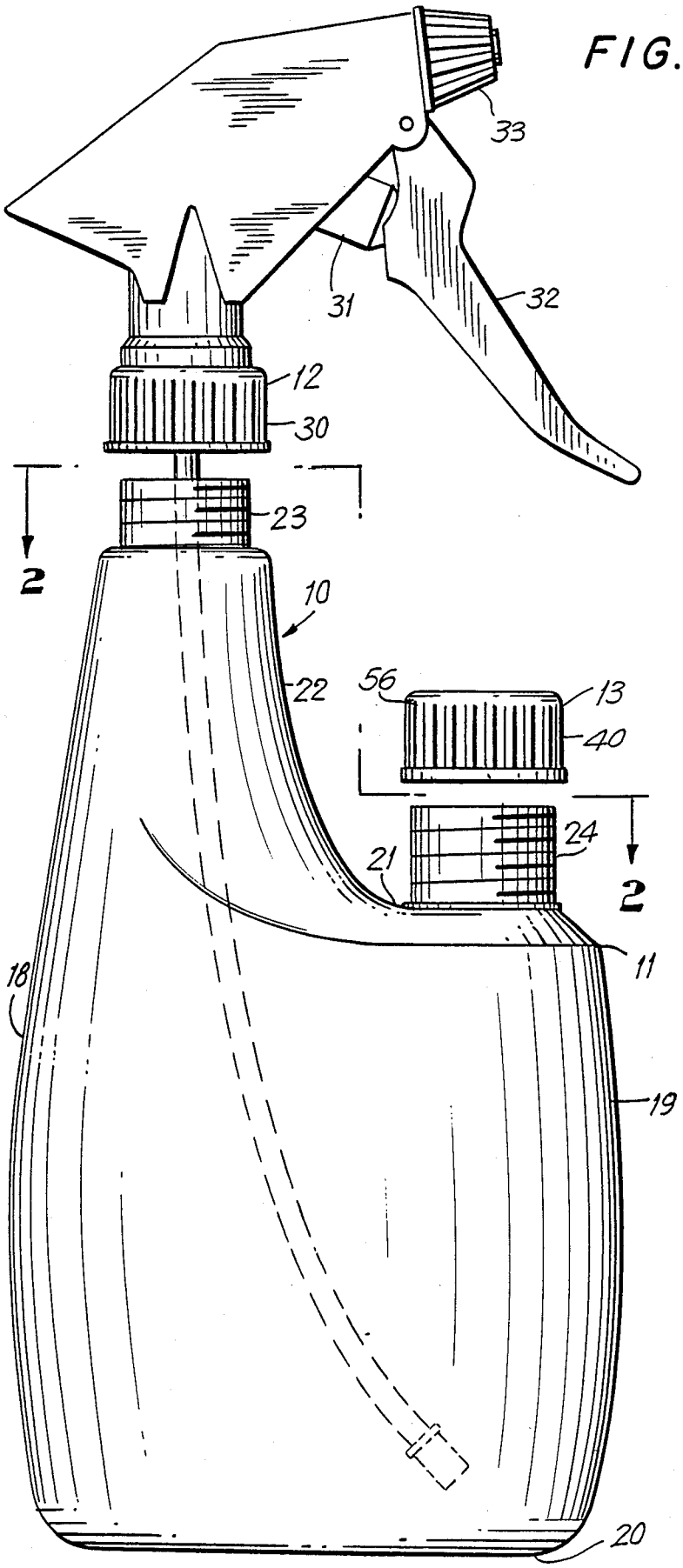
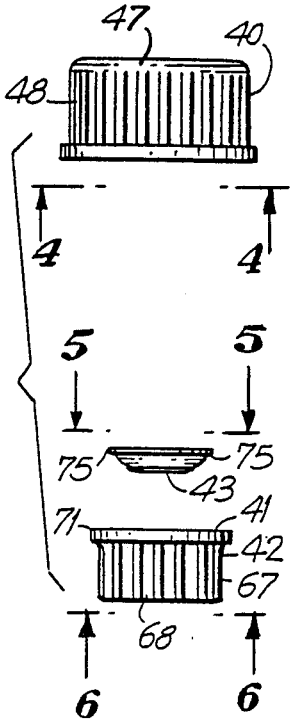
FIG. 3

THREADED CAP CONTAINING ADDITIVE FOR CONTAINERS

BACKGROUND OF THE INVENTION

This invention relates generally to the field of hand-held liquid dispensers of a type used, for example in the spraying of liquid insecticides, fungicides, window cleaning solutions, and the like. More particularly, it is directed to the position of an improved means permitting the user to conveniently make a solution from a premeasured liquid concentrate without the necessity of contacting the materials used, and without danger of spillage.

It is known in the art to provide dispensers containing a concentrate of soluble materials which are engaged in line with a liquid conduit in such manner that a discreet amount of concentrate is mixed with the liquid as it flows past the point of engagement. The concentrate is usually in solid form and is effectively dissolved in a continuous manner at a desired rate.

It is also known to provide watering cans and the like having means incorporating a dispenser for a concentrate, such as powdered soap which is discharged into water contained in the can on a cyclic basis.

To the best of my knowledge, the prior art includes no provision for a user to mix small quantities of solutes within a hand-held container filled with water or the like using capsule-like charges of solute for immediate use at predetermined concentrations, and in which the container is refillable when the mixed contents thereof have been exhausted.

SUMMARY OF THE INVENTION

Briefly stated, the invention contemplates the provision of an improved device capable of rapidly mixing and dispensing a chemical solution adapted to accomplish a desired result which may be recharged easily by a user without the necessity of contacting the charging element or the solute. By varying the contents of the charging element, solutions for particular uses are obtained using the same dispensing container. In accordance with the invention, the container is formed to include two threaded neck members, a first of which is adapted to carry a manually operated spray element A second neck is provided on an upper wall of the container and is threadedly engageable with a cap having an axially positioned receptacle containing a desired solute which is discharged directly into the interior of the container after the cap has been secured in place. In one embodiment, the rupturable element is opened as a result of tightening the cap upon the second neck. In another embodiment, the result is obtained through the use of a manually operated plunger.

BRIEF DESCRIPTION OF THE DRAWING

In the drawing, to which reference will be made in the specification, similar reference characters have been employed to designate corresponding parts throughout the several views.

FIG. 1 is an exploded view in elevation of a first embodiment of the invention.

FIG. 3 is an exploded view in elevation of a combination cap and additive containing element forming part of the first embodiment.

DETAILED DESCRIPTION OF THE DISCLOSED EMBODIMENTS

Figure 2:
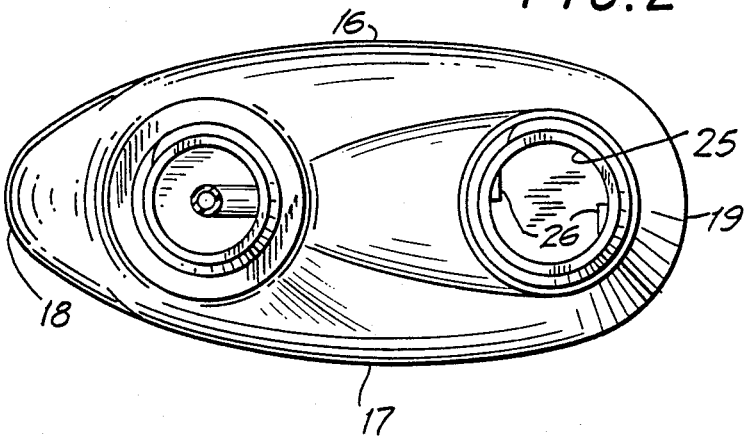
FIG. 2 is a top plan view thereof with certain of the component parts removed for purposes of clarity.

In accordance with the invention, the device, generally indicated by reference character 10, comprises broadly: a molded container element 11, a dispensing element 12 and a charging element 13.

The container element 11 is preferably formed from flexible synthetic resinous material, and is most conveniently blow molded to include first and second side walls 16 and 17, first and second end walls 18 and 19, a lower wall 20, and an upper wall 21. The upper wall forms an extension 22 which terminates in a first threaded neck 23. Laterally oriented from the neck 23 is a second threaded neck 24 having an inner surface 25 which is provided with one or more radially-extending projections 26, the purpose of which will more fully appear hereinafter.

The dispensing element 12 may be of any suitable type, as for example, that illustrated in FIG. 1 which includes a threaded engagement means 30, a pump member 31 having an operating handle 32 and a spray nozzle 33. It will be understood that the showing of the dispensing element 12 is purely exemplary, and may be substituted by other dispensing means, depending upon contemplated use of the device.

The charging element 13 is also most conveniently formed from molded synthetic resinous materials, and includes an outer cap element 40 which encloses a rupturable element 41, the element 41 including a sleeve member 42 and an end wall member 43.

Figure 4:
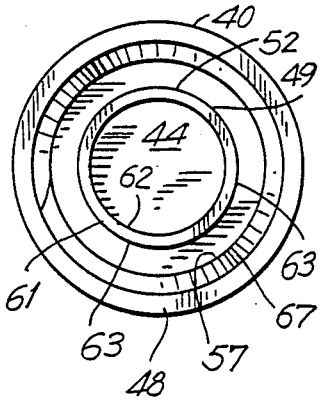
FIG. 4 is a view in elevation as seen from the plane 4—4 in FIG. 3.
Figure 5:
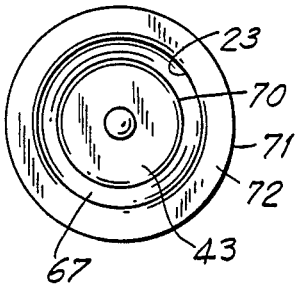
FIG. 5 is a view in elevation as seen from the plane 5—5 in FIG. 3.
Figure 6:
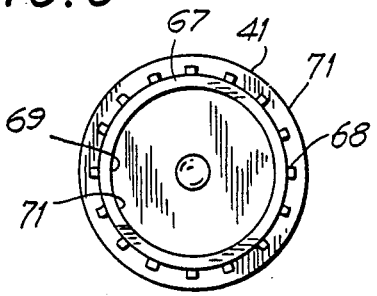
FIG. 6 is a view in elevation as seen from the plane 6—6 in FIG. 3.
Figure 7:
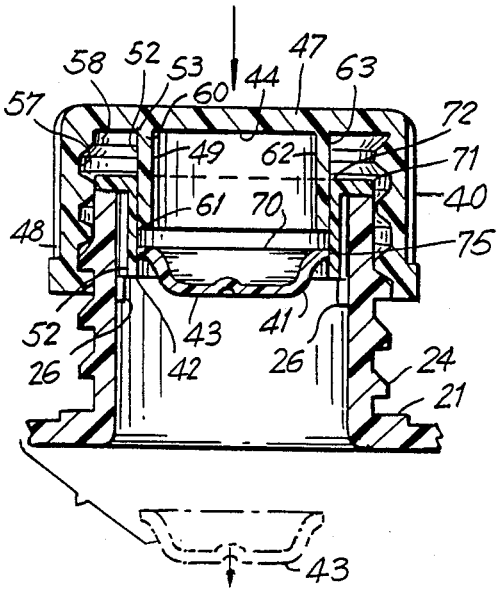
FIG. 7 is a longitudinal central sectional view as seen from the plane 7—7 in FIG. 3 with the component parts in assembled condition.

The outer cap element 40 (See FIGS. 3 and 4) includes an end wall 47 and a cylindrical side wall 48. Extending from an inner surface 44 of the end wall 47 is an axially positioned cylindrical sleeve 49. An outer surface 52 thereof is bounded by a peripheral edge 53 where it meets the end wall 47.

The side wall 48 includes an outer knurled surface 56 as well as an inner threaded surface 57 terminating in a circular gasket-retaining recess 58. The sleeve 49 includes an upper end 60, and a lower edge surface 61 and is bounded by inner and outer surfaces 62 and 63.

The rupturable element 41 is conveniently molded from polyethylene, or similar composition. It includes a cylindrical wall 67 bounded by a longitudinally serrated outer surface 68 and an inner surface 69 defining a circular groove 70. A flanged gasket member 71 extends radially outward from the inner end 72 and is adapted to engage the recess 58 to create a seal. Positioned within the groove 70 is the end wall member 43 having a free peripheral edge 75, the wall member 43 normally overlying the cylindrical sleeve 49. There is, thus formed, a void capable of retaining a discreet amount of concentrate prior to dispensing the same into the container element 11.

Normally, the charging element 13 will be distributed in detached condition with respect to the container element 11, and engaged by the user therewith after the container element has been filled with water or other desired solvent. As the charging element 13 is threadedly engaged with the second neck 24, the free end edge of the cylindrical wall 67 will contact one or more of the projections 26, so that further rotational movement will serve to distort the wall 67 from its cylindrical configuration. At a certain point, the edge 75 will be disengaged from the groove 70, and the free edge of the sleeve 49, with continued rotation of the outer cap element 40 will force the wall member 43 open, permitting the liquid contents disposed thereabove to fall into the container element 11. The cap element 40 will normally be left in position until the contents of the container element are dispensed, at which point the cap is removed, the container element refilled with water, and a second charging element 13 engaged.

Figure 8:
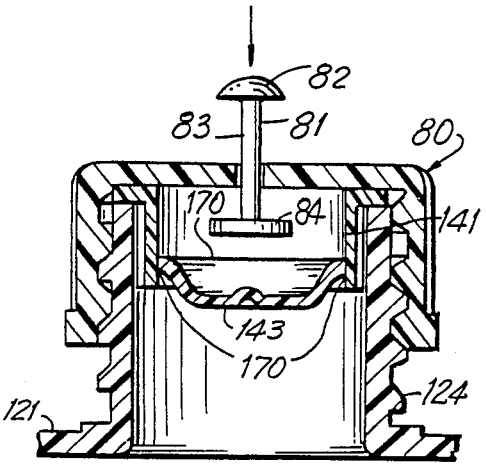
FIG. 8 is a longitudinal central sectional view corresponding to that seen in FIG. 7, but showing a second embodiment of the invention.

Turning now to the second embodiment of the invention, as illustrated in FIG. 8 in the drawing, and generally indicated by reference character 80, parts corresponding to those of the principal embodiment have been designed by similar reference characters with the additional prefix "1".

The second embodiment differs from the principal embodiment in the provision of a manually operable plunger 81 for opening the rupturable element after the outer cap element has been positioned. The plunger 81 includes an outer end 82 which is manually engageable, and which interconnects to a shaft member 83 and to an inner end 84 which is adapted to contact an inner surface 85 of the end wall 143. Use of the second embodiment is generally similar to that of the first embodiment except that the rupturing of the element 141 does not occur automatically, there being a requirement for manual actuation.

I wish it to be understood that I do not consider the invention to be limited to the precise details of structure shown and set forth in this specification, for obvious modifications will occur to those skilled in the art to which the invention pertains.

I claim:

1. In combination, a container element having first and second threaded necks forming openings communicating with the interior of said container, a liquid dispensing element selectively threadedly engaged upon said first neck, and communicating therewith and a threaded charging element selectively engaged upon said second neck, said charging element including: an outer cap element having a planar end wall, a cylindrical internally threaded side wall, a rupturable element having a cylindrical side wall having a first end forming a gasket between said outer cap element and said second neck element, and having a second end defining an annular retaining groove, and a circular bottom wall having a peripheral edge selectively positioned within said groove to form a liquid retaining chamber, said planar end wall having a through opening therein; a manually operable plunger having a first end projecting through said end wall, and a second end selectively contacting said bottom wall, and serving to at least partially disengage said wall to permit said charging element to empty the contents thereof into said container element.

* * * * *